United States Patent [19]

Izaguirre, Sr. et al.

[11] Patent Number: 5,011,073

[45] Date of Patent: Apr. 30, 1991

[54] CONTROL TO OPERATE A FORCED AIR BLOWER

[75] Inventors: Lowell F. Izaguirre, Sr.; Jose M. Perotti, both of Miami, Fla.

[73] Assignee: Cam-Stat, Inc., Hialeah, Fla.

[21] Appl. No.: 431,291

[22] Filed: Nov. 3, 1989

[51] Int. Cl.[5] ..... F23N 3/00

[52] U.S. Cl. ..... 236/11; 236/46 E

[58] Field of Search ..... 236/11, 10, 46 F, 46 E, 236/46 R; 165/12; 62/158, 157, 231

[56] References Cited

U.S. PATENT DOCUMENTS 4,369,916 1/1983 Abbey ..... 236/11

4,485,966 12/1984 Cartmell et al. ..... 236/46 R 4,684,060 8/1987 Adams et al. ..... 236/11

4,773,586 9/1988 Ryan ..... 236/11

*Primary Examiner*—Harry B. Tanner

*Attorney, Agent, or Firm*—Julian C. Renfro.

[57] ABSTRACT

An electronic control for a warm air furnace blower including an input circuit for receiving a signal from a thermostat. The signal is delayed by a first adjustable time delay to operate a blower relay, which energizes the blower. When the input signal ceases, a second adjustable time delay serves to delay opening of the blower relay. A second input circuit for receiving an emergency signal operates the blower relay without delay, and the second time delay serves to delay opening of the blower relay after the emergency signal ceases.

9 Claims, 1 Drawing Sheet

CONTROL TO OPERATE A FORCED AIR BLOWER

BACKGROUND OF THE INVENTION

1. Field of the Invention

The present invention relates to warm air furnace controls, and more particularly to an electronic control for the forced air blower of a furnace, having an ON-OFF delay circuit in which the ON-time and OFF-time are separately adjustable.

2. Description of the Prior Art

Conventional warm air furnaces measure the temperature in the heat exchanger and turn on the forced air blower when the temperature rises above a selected value. When the temperature drops below a lower selected value, the blower is turned off. Generally, the control is a mechanical thermostat having the hysteresis between the on and off temperatures adjustable. However, improvements in the design of such furnaces to obtain higher efficiencies have involved new materials and reduced wall thicknesses to improve heat transfer. These changes have resulted in a faster drop in heat retained in heat exchangers, allowing higher temperature differentials between the fire side and the air side of the heat exchanger. The maximum temperature and the amount of change in temperature between burner-ON and burner-OFF has been significantly lowered Existing thermostats depend on the changes in temperature to provide mechanical energy to operate, and these are not suitable to directly control blowers of such modern furnaces directly. One approach to the problem is to utilize a delay-0N timer and a delay-OFF timer connected to an external relay that operates the blower. The timers delay the turn-ON of the blower when the thermostat closes, and lengthens the blower operation when the thermostat opens. To operate the blower when the furnace overheats, a separate control has been provided.

There is a clear need for a low cost, electronic blower control circuit having a single time delay network in which the "ON" delay and "OFF" delay are independently adjustable, with the same circuit monitoring the over-temperature control.

SUMMARY OF THE INVENTION

This invention provides a blower relay driver circuit for operating the blower motor of a warm air furnace. The relay is operated by an electronic switch, the switch being controlled by a first operational amplifier, which is biased to a HIGH output when the blower is off. A second operational amplifier has its input connected to receive the signal from the furnace thermostat when its contacts are closed. The output of the second amplifier charges an adjustable "on" time delay network via a forward diode. The output of the delay network is connected to the first operational amplifier. When the network is fully charged, the first operational amplifier goes LOW, causing the electronic switch to operate the blower relay. As will be understood, the blower operation is delayed after occurrence of the thermostat ON signal, and the delay may be adjusted in accordance with the desired hysteresis between blower ON-time and OFF-time.

When the blower is operating and the thermostat contacts open, the second operational amplifier goes LOW, permitting the ON time delay network to discharge via a reversed diode through an OFF-time delay network, the time of discharge advantageously being adjustable. When the discharge is complete, the first operational amplifier is again biased to HIGH, causing the blower motor relay to open.

An emergency signal may be produced by an "overheat" thermostat, or by a manual switch for energizing the blower motor. The emergency signal is applied to a detector connected to the first operational amplifier for operating the blower relay without an ON delay. When the emergency signal ends, the first operational amplifier time delays HIGH, turning the blower off.

As will be recognized, the above disclosed system can be constructed with low cost integrated circuits and low cost circuit elements.

It is therefore a principal object of the invention to provide a blower control for a warm air furnace in which a single delay circuit is used for providing delays in the blower-0N and blower-OFF condition, in which the ON-delay and the OFF-delay are independently adjustable.

It is another object of the invention to provide a blower control for a warm air furnace, providing separately adjustable ON-delay time and OFF-delay time, and which also monitors an emergency signal for operating the blower.

It is still another object of the invention to provide an adjustable electronic blower control system using low cost components, controllable by a thermostat and a manual or emergency signal.

These and other objects, features and advantages of the invention will become apparent from the following detailed description when read in conjunction with the drawings.

DETAILED DESCRIPTION OF THE PREFERRED EMBODIMENT

Figure 1:
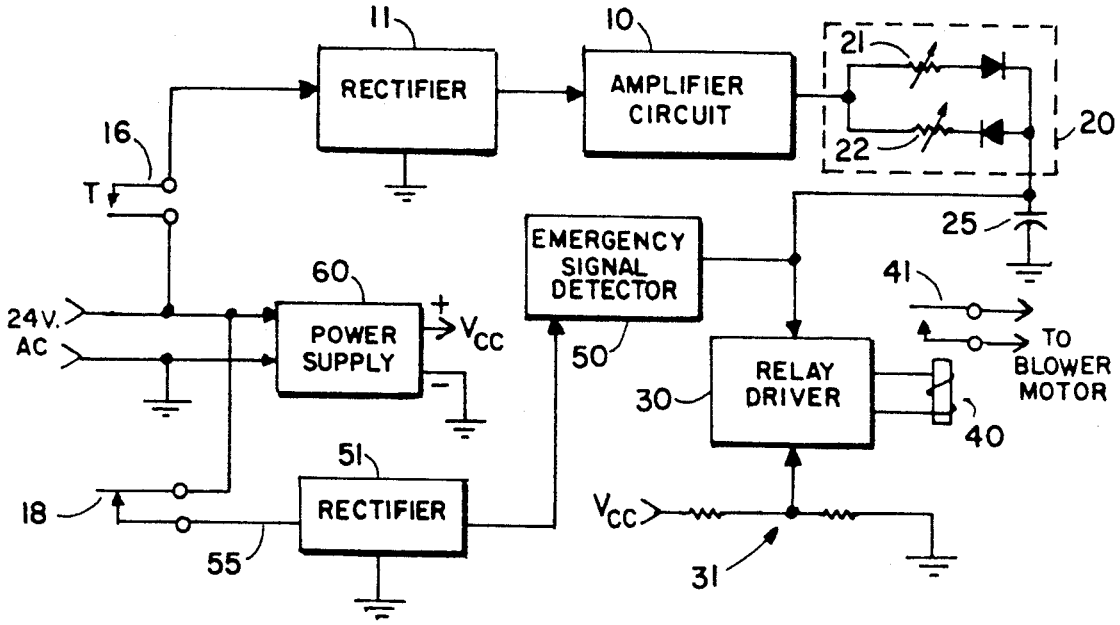
FIG. 1 is a simplified block diagram of the blower control system of the invention.

Referring to FIG. 1, a functional block diagram of the control system of the invention is shown. The system operates from low voltage; for example, from 24 volts ac. Power supply 60 provides dc operating voltage $V_{cc}$ to the electronic circuits. The system serves to energize the blower motor of a warm air furnace when the burner is ignited. Contacts 16 of a thermostat disposed in the furnace heat exchanger close, responsive to heat from the burner. The blower motor is operated by closure of relay contacts 41 of relay 40.

It is required to introduce a time delay between the time that thermostat contacts 16 close and the time that relay contacts 41 are closed. Relay driver circuit 30 is biased to the nonconductive state by a positive bias voltage from voltage divider 31. Closure of thermostat contacts 16 connects 24 volt ac to rectifier 11 and the rectified voltage is applied to amplifier circuit 10 which charges an ON-OFF time delay circuit 20. The period of the ON-delay is controlled by variable resistor 21. When capacitor 25 charges to a preselected voltage, the bias on relay driver 30 is overcome, and relay 40 closes, operating the blower motor.

When the furnace burner shuts off, and thermostat contacts 16 open, amplifier circuit 10 is cut off and capacitor 25 discharges through the OFF-time portion of ON-OFF delay circuits 20. The OFF-time delay is adjustable by variable resistor 22. At the end of a preselected delay period, the charge on capacitor 25 is to a selected low value, causing relay driver 30 to be cut off, and relay 40 to open, turning the blower motor off.

In addition to operating the blower motor, responsive to the heat exchanger temperature, the system of FIG. 1 also energizes the blower motor responsive to an emergency signal from a normally operated switch or from thermostat contacts 18. The normally-closed contacts 18 apply the 24 volt ac to rectifier 51 which biases emergency detector 50 such that relay driver 30 is off. If overheating of the furnace is detected, for example, contacts 18 will open, removing the ac signal which is rectified by rectifier 51, triggering emergency detector 50. As will be noted, the output from detector 50 immediately operates relay driver 30, closing relay 40 for operating the blower motor.

Figure 2:
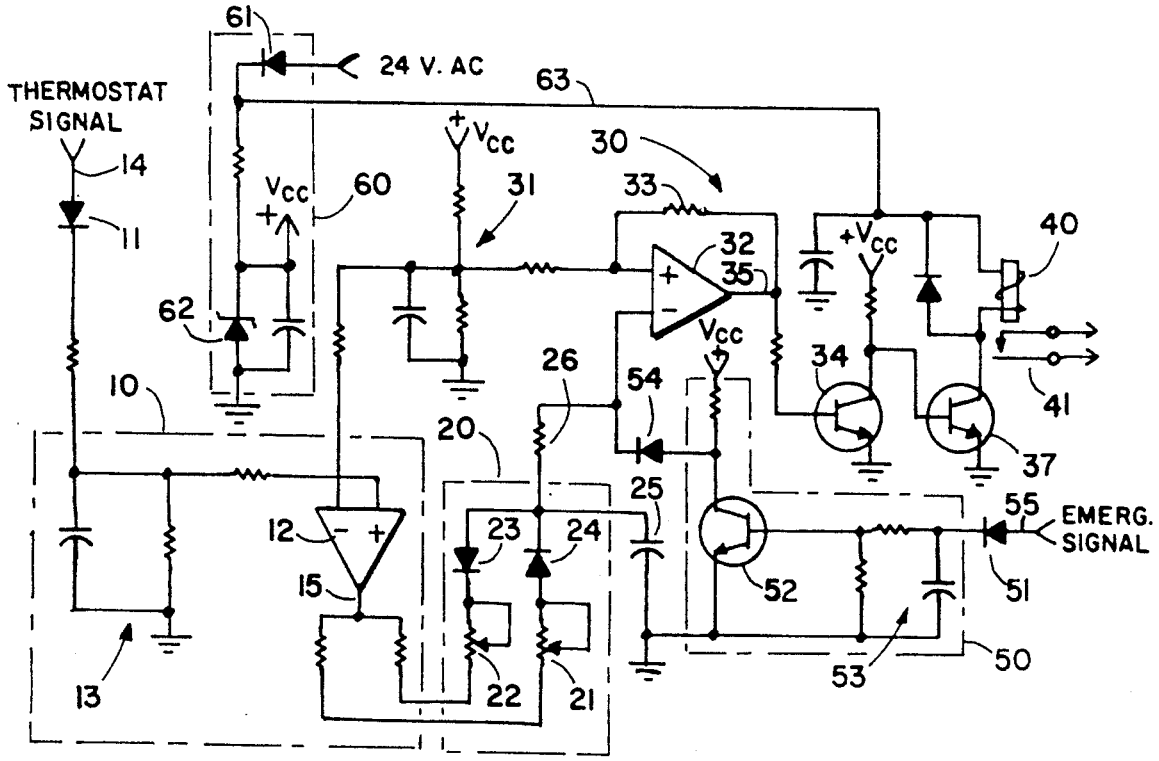
FIG. 2 is a schematic diagram of the preferred embodiment of the invention.

A schematic circuit diagram of the blower control system of the preferred embodiment of the invention is shown in FIG. 2. The 24 volt ac is applied to power supply 60, rectified by diode rectifier 61, and the dc voltage output regulated by zener diode 62 to supply dc voltage $V_{cc}$ for the electronic circuitry. Unregulated dc via lead 63 is utilized by relay driver circuit 30 for operating blower motor relay 40.

Amplifier 32, which may be an operational amplifier, has its positive input biased via voltage divider 31 from supply voltage $V_{cc}$ to produce a HIGH at its output 35. Transistor 34 is turned on, producing a LOW at the input of transistor 37, turning transistor 37 off. Therefore, relay 40 is nonoperated and relay contacts 41 are open. This state occurs when no thermostat signal is present at input 14.

When 24 volts ac appears at input 14 from the closing of the heat exchanger thermostat, it is rectified by diode 11 and filtered by filter 13 to apply a positive voltage to the positive input of amplifier 12 of amplifier circuit 10. Amplifier 12 may be an operational amplifier. The reference voltage on the negative input of operational amplifier 12 from voltage divider 31 normally produces a LOW on output lead 15. The positive voltage on the positive input is greater than the reference, thereby producing a HIGH at output lead 15. Assuming that capacitor 25 of time delay circuit 20 is essentially discharged, it will charge through variable resistor 21 and diode 24 to a positive voltage. The time constant is selected to produce a slow rise in voltage on capacitor 25, with adjustment of resistor 21 permitting the turn-on delay time to be varied.

The voltage across capacitor 25 appears at the negative input of operational amplifier 32. When this voltage exceeds the reference voltage from divider 31, a LOW is produced on output lead 35 of operational amplifier 32. The LOW which is coupled to the positive input of operational amplifier 32 by resistor 33, causing an abrupt toggling action. The LOW also turns transistor 34 off and transistor 37 on, operating blower motor relay 40. Thus, the blower operation has been delayed by the desired delay time.

When the thermostat signal on lead 14 is removed at the time the blower is to be turned off, operational amplifier 12 goes LOW on lead 15. The positive charge on capacitor 25 discharges through diode 23 and variable resistor 22, reducing the voltage on the negative input of operational amplifier 32. This action turns operational amplifier 32 ON which causes relay 40 to open. As will be recognized, the turn-off time delay between the turn off of the thermostat signal and the opening of relay 40 may be independently varied by adjustment of resistor 22. Although variable resistors 21 and 22 are preferred, adjustment may be made by selection of appropriate fixed resistors.

When an emergency signal from opening of contacts 18 of a standard limit control (FIG. 1), such as a thermostat, appears on lead 55, it is desired to close relay 40 without a delay. Normally, the ac signal on lead 55 is rectified by diode 51 and filtered by filter 53, turning transistor 52 on. When the signal is removed by opening of limit control contacts 18, transistor 52 turns off, producing a HIGH at the input of operational amplifier 32 via diode 54, thus bypassing the time delay circuits to activate relay 40. The HIGH also charges capacitor 25 through resistor 26, allowing for an OFF delay when the emergency signal is removed.

An electronic blower motor control system has been disclosed that can be produced at low cost, and that utilizes a simple time-delay circuit permitting independent selection of ON-delay and OFF-delay. Although a specific embodiment of the system is disclosed herein, the disclosure is for exemplary purposes only and various modifications may be made without departing from the spirit and scope of the invention.

We claim:

1. A control circuit for controlling an electric motor operated air blower responsive to a control signal from a thermostat comprising:

(a) ON-OFF control means operatively connected to said blower motor;

(b) input means for receiving an ON control signal from said thermostat; and (c) delay means connected between said input means and said ON-OFF control means, said delay means having a first adjustment means for selecting a turn-on delay when said ON control signal is received, and a second adjustment means for selecting a turn-off delay when said ON control signal ceases, said input means including:

(d) a rectifier for rectifying an ac ON control signal; and (e) an amplifier circuit for receiving said rectified control signal;

said first adjustment means of said delay means including (f) a first adjustable resistor connected between said amplifier circuit and a first diode to a capacitor, said capacitor receiving a charging current from said amplifier circuit via said first resistor and said first diode when said rectified control signal is present at said amplifier circuit, whereby a first selected voltage of said capacitor turns on said control means;

said adjustment means of said delay means including (g) a second adjustable resistor connected between said amplifier circuit and a second diode to said capacitor, said capacitor discharging through said second diode, said second resistor and said amplifier circuit upon cessation of said rectified control signal, whereby a second selected voltage on said capacitor turns off said control means.

2. The control circuit as defined in claim 1 in which said control circuit further includes:

second input means for receiving an externally generated signal during an OFF-time of said blower motor for turn-on of said blower motor; and means responsive to said externally generated signal for turing on said control means without delay.

3. The control circuit as defined in claim 2 in which said externally generated signal is produced automatically, indicative of an emergency.

4. The control circuit as defined in claim 2 in which said second input means includes an amplifier having an output connected via a third diode to said capacitor whereby said external signal causes said capacitor to charge to said first selected voltage without significant delay and to thereby turn on said control means.

5. The control circuit as defined in claim 4 in which said capacitor charged responsive to said emergency signal discharges through said second diode, said second resistor and said amplifier circuit when said external signal ceases.

6. In a warm air furnace having an electrical motor driven forced air blower, the improvement in an electronic blower control circuit comprising:

an input circuit for receiving an ac control signal;

a rectifier circuit connected to receive the ac control signal and produce a dc control signal therefrom;

an amplifier connected to receive the dc control signal, and to produce a high level output therefrom;

a first time delay circuit having a capacitor connected to be charged via the high level output of said first amplifier via a first resistor and a first diode, said first resistor being selectively adjustable to produce a desired charging time;

a relay driver circuit connected to said capacitor;

a relay operatively connected to said blower motor, and to said relay driver circuit, said relay driver circuit being responsive to a first preselected voltage of said capacitor to close said relay, thereby energizing said blower motor; and a second time delay circuit formed by said capacitor connected to a second diode in series with a second resistor to said operational amplifier for discharging said capacitor when said ac control signal ceases, said second resistor being selectively adjustable to provide a desired discharge time, thereby causing said relay driver circuit to release said relay at a second preselected voltage on said capacitor.

7. The improvement as defined in claim 6 which further comprises:

an emergency signal input for receiving an emergency signal; and a second amplifier connected to receive said emergency signal, the output thereof connected via a third diode to quickly charge said capacitor to said first preselected voltage when said emergency signal is present, whereby said capacitor discharges through said second diode, said second resistor and said operational amplifier, thereby producing a turn-off delay of said blower motor when said emergency signal ceases.

8. The improvement as defined in claim 7 in which said relay driver circuit includes:

a third amplifier having a bias on its positive input to produce a HIGH output and having direct coupling from its output to said positive input; the negative input of said amplifier connected to said capacitor; and a transistor switch operatively connected to said relay for operating said relay when said output of said operational amplifier is LOW, wherein the first preselected voltage of said capacitor causes a LOW at said operational amplifier output to be fed back via said direct coupling to overcome said bias and thereby operating said transistor switch.

9. The improvement as defined in claim 8 in which said third amplifier is an operational amplifier.

* * * * *